US007402230B2

(12) United States Patent
Yoo et al.

(10) Patent No.: US 7,402,230 B2
(45) Date of Patent: Jul. 22, 2008

(54) METHOD OF MANUFACTURING A LOW MAGNETIC LOSS METAL TAPE WITH BIAXIAL TEXTURE

(75) Inventors: Jai-Moo Yoo, Kyungsangnam-do (KR); Young-Kuk Kim, Kyungsangnam-do (KR); Jae-Woong Ko, Kyungsangnam-do (KR); Kook-Chae Chung, Kyungsangnam-do (KR)

(73) Assignee: Korea Institute of Machinery and Materials, Daejeon (KR)

( * ) Notice: Subject to any disclaimer, the term of this patent is extended or adjusted under 35 U.S.C. 154(b) by 316 days.

(21) Appl. No.: 11/074,568

(22) Filed: Mar. 7, 2005

(65) Prior Publication Data

US 2006/0159949 A1 Jul. 20, 2006

(30) Foreign Application Priority Data

Jan. 20, 2005 (KR) ..... 10-2005-0005428

(51) Int. Cl.
*C25D 1/04* (2006.01)
*C25D 5/04* (2006.01)

(52) U.S. Cl. ..... 205/77; 205/138

(58) Field of Classification Search ..... 205/76, 205/138

See application file for complete search history.

(56) References Cited

U.S. PATENT DOCUMENTS

| | | | | |
|---|---|---|---|---|
| 5,741,377 | A * | 4/1998 | Goyal et al. | 148/512 |
| 5,863,410 | A * | 1/1999 | Yates et al. | 205/585 |
| 6,346,181 | B1 * | 2/2002 | Lee et al. | 205/89 |
| 6,670,308 | B2 * | 12/2003 | Goyal | 505/434 |
| 2004/0206630 | A1 * | 10/2004 | Kruger et al. | 205/223 |

* cited by examiner

*Primary Examiner*—Susy N Tsang-Foster
*Assistant Examiner*—William T Leader
(74) *Attorney, Agent, or Firm*—Cooper & Dunham LLP

(57) ABSTRACT

The present invention is provided to manufacture a low magnetic loss metal tape with biaxial texture and a manufacturing method thereof. The low magnetic loss metal tape has a non-magnetic metal layer deposited on a nickel layer in the form of stack. The low magnetic loss metal tape with biaxial texture is manufactured by the following steps. A biaxially textured nickel layer is formed on a surface of cathode rotating in an electroplating bath including a cathode with single crystalline structure or similarly high orientation, and an anode made of high purity nickel. The nickel layer formed on the cathode is then washed in a water bath. Subsequently, a non-magnetic metal layer is formed on the washed nickel layer rotating in a plating bath with a non-magnetic metal solution. The metal tape is finally manufactured by delaminating and winding the nickel/non-magnetic metal layers.

4 Claims, 6 Drawing Sheets

(A)

(B)

(A)

(B)

(A)

(B)

(C)

(D)

METHOD OF MANUFACTURING A LOW MAGNETIC LOSS METAL TAPE WITH BIAXIAL TEXTURE

BACKGROUND OF THE INVENTION

1. Field of the Invention

The present invention relates to a low magnetic loss metal tape with biaxial texture and a manufacturing method thereof. More particularly, the present invention relates to a manufacturing method of a low magnetic loss metal tape with biaxial texture by providing metal layers in a multi-layer structure, such as nickel and non-magnetic metal layers, with an electroplating method being performed near room temperature. The ferromagnetic characteristic of the nickel layer may effectively be avoided by utilizing this method.

2. Description of the Prior Art

The efficiency of electric power equipment may generally be influenced by energy loss during the operation of electric power equipment. Intensive works related to utilizing superconducting wires without electric resistance have been carried out, in order to minimize energy loss in the electric power equipment and to increase the efficiency of the equipment. Particularly due to the characteristics of high critical current and low production cost, it is expected that the research and development on a coated superconductor will make great contributions to the improvement of performance and efficiency of the electric power equipments in the field of high-capacity electric power equipments. The coated conductor is a material in a tape or linear shape, in which a superconducting substance is included to transport a high flow of current.

FIG. 1 is a schematic drawing of a coated superconductor.

As shown in FIG. 1, the coated conductor has a structure including a biaxially textured metal tape, a buffer layer, a superconducting layer, and a protective layer. A biaxially textured metal tape is essential for fabrication of coated conductor with high electrical performance. Especially, the magnetic loss of the biaxially textured metal tape should be low enough to decrease an alternating current (AC) loss in the application of electric power equipments using the coated conductor.

Currently, a nickel-based metal tape is generally used as a substrate for coated conductor. However, nickel shows ferromagnetic characteristics, which causes a magnetic loss, and means for restraining the characteristic of ferromagnetism is required to reduce the magnetic loss.

Ferromagnetism is a magnetic property of material having macroscopic magnetization without any influence of external magnetic field. The ferromagnetism is induced by the interaction of magnetic moments between electrons' spin and orbital angular movement in a material. If a ferromagnetic material is heated above a specific temperature called the Curie temperature of the material, the ferromagnetic property of the material disappears. Some ferromagnetic materials do not show a magnetic property. It is because individual magnetic domains formed internally have ferromagnetic properties, however magnetic moments of them are oriented in the opposite directions relative to each other, resulting compensation as a whole.

It is possible to make the material magnetized by engaging an external magnetic field to reorient the individual magnetic domains. In this case, the individual magnetic domains don't go back to their initial state, even though the external magnetic field is removed completely. A phenomenon that a magnetic property is being changed by a structural change of magnetic domain, according to engaging or disengaging the external magnetic field, is called magnetic hysteresis.

Currently, Rolling-assisted Biaxially Textured Substrate (RaBiTS) process is generally used to manufacture biaxially textured metallic substrates for coated conductors. The RaBiTS process includes the steps of manufacturing a basic material, rolling and heat treatment. In order to restrain magnetic loss of biaxially textured metallic substrates for coated conductors, non-magnetic metals such as Chromium, Tungsten, etc. are alloyed in manufacturing basic materials.

However, in the case that a large amount of the non-magnetic metal is added into a nickel alloy to restrain the ferromagnetic characteristic, the mechanical characteristics of metal substrate are deteriorated. Accordingly, cracks or irregular surface characteristics may frequently be caused in mechanical processing such as a rolling process. Therefore, it is recommended to limit addition of non-magnetic metal in the low range of several percents. In the case of a typical metal tape having a Ni—W constitution among nickel alloy substrates manufactured by the RaBiTS process, nickel with the thickness of about 1 μm may have to be deposited to form a buffer layer. Accordingly, there is a problem that precise mechanical processing and additional processes are required in many cases to manufacture a non-magnetic alloy substrate.

It has been recently reported that a biaxial texture may be induced by using a metal cathode having single crystalline or similarly high orientation in an electroplating process, without applying any external force (Korean Patent Application No. 10-2003-0021091, and U.S. App. Pub. No. 10-608,67). In this process, high orientation of the cathode is transferred to a plated metal layer, and thereby an electroplated metal layer with biaxial texture can be obtained. Continuous electroplating with a non-magnetic metal alloy is required to manufacture a low magnetic loss metal tape. However, it is not easy to control the constitution and orientation of the electroplated metal layer in alloy plating process. In addition, the mechanical properties of metal layer can be deteriorated by defects such as cavity, and cracks which can be formed in alloy plating process.

SUMMARY OF THE INVENTION

The present invention is disclosed to solve the aforementioned various problems in the prior art. An object of the present invention is to provide a low magnetic loss metal tape with biaxial texture and a production method thereof, by manufacturing a multi-layer metal tape with nickel/non-magnetic metal layers in an electroplating process using a proper plating bath in order to restrain hysteresis loss and to improve biaxial texture.

The low magnetic loss metal tape with biaxial texture in accordance with the present invention is provided in the form that a non-magnetic metal layer is deposited onto a nickel layer.

The non-magnetic metal layer deposited onto the nickel layer may be formed of copper (Cu), zinc (Zn), tin (Sn), silver (Ag), gold (Au), manganese (Mn), chromium (Cr), vanadium (V), aluminum (Al), tantalum (Ta), tungsten (W), or a metal alloy thereof.

The non-magnetic metal layer may be provided in the form of a single-layer or multi-layer deposited onto the nickel layer.

The nickel layer and the non-magnetic metal layer may be deposited by an electroplating method.

The manufacturing method of a low magnetic loss metal tape with biaxial texture in accordance with the present invention comprises the steps of: (A) forming a nickel layer with biaxial texture on a surface of cathode rotating in an electroplating bath including a cathode with single crystalline or similary high orientation, and an anode made of high purity nickel; (B) washing the nickel layer formed on the cathode in a water bath; (C) forming a non-magnetic metal layer on the washed nickel layer in a plating bath with a non-magnetic metal solution; (D) winding a metal tape by delaminating the nickel/non-magnetic metal layers.

The cathode may be formed in a cylinder or belt shape and the anode may be formed in a curve or plate shape.

The non-magnetic metal layer may include copper (Cu), zinc (Zn), tin (Sn), silver (Ag), gold (Au), manganese (Mn), chromium (Cr), vanadium (V), aluminum (Al), tantalum (Ta), tungsten (W), or a metal alloy composed thereof.

Additionally, before the step (A) of forming nickel layer, the cathode may be treated with electrolytic polishing to smoothen the surface of the cathode. The cathode is then dipped, at an interval from several seconds to several tens of minutes, in a solution containing one of 0-10 mol hydrochloric acid, 0-10 mol nitric acid, 0-10 mol sulfuric acid, 0-10 mol acetic acid, 0-10 mol chromic acid, 0-10 mol potassium dichromate, 0-10 mol fluoric acid, 0-10 mol lithium hydroxide, 0-10 mol sodium hydroxide, 0-10 mol potassium hydroxide, 0-10 mol ammonia water, 0-10 mol hydrogen peroxide, or a combination of two or more components. Subsequently, the cathode may be washed and dried. By the above pretreatment, the metal layer becomes to be easily delaminated.

Additionally, in the step (A) of forming a nickel layer, a plating solution may be prepared with some or all of 0-600 g/l nickel sulfate, 0-600 g/l nickel sulfamate, 10-70 g/l nickel chloride, 20-80 g/l boric acid, 0-10 g/l sodium tungstate ($NaWO_3$), 0-10 g/l cobalt chloride. The plating solution may have the pH range 1.5-6. The reason why the concentrations are limited to the above ranges is because the metal layer is well formed in this condition.

DETAILED DESCRIPTION OF THE PREFERRED EMBODIMENTS

A low magnetic loss, multi-layer metal tape with biaxial texture and a manufacturing method thereof in accordance with the present invention will be described in more detail as follows.

Figure 1:
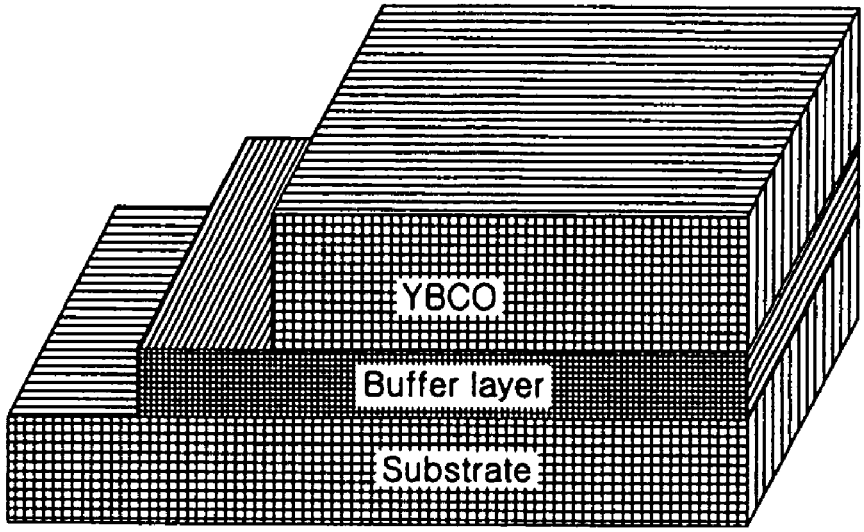
FIG. 1 is a schematic drawing of a coated superconductor.
Figure 2:
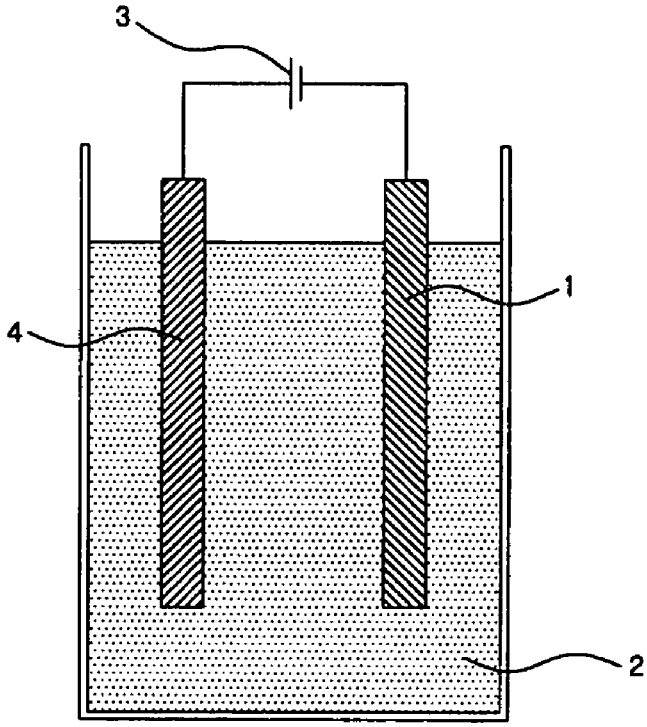
FIG. 2 is a conceptual drawing of a metal plating bath and auxiliary devices for electroplating in accordance with an exemplary embodiment of the present invention.
Figure 3:
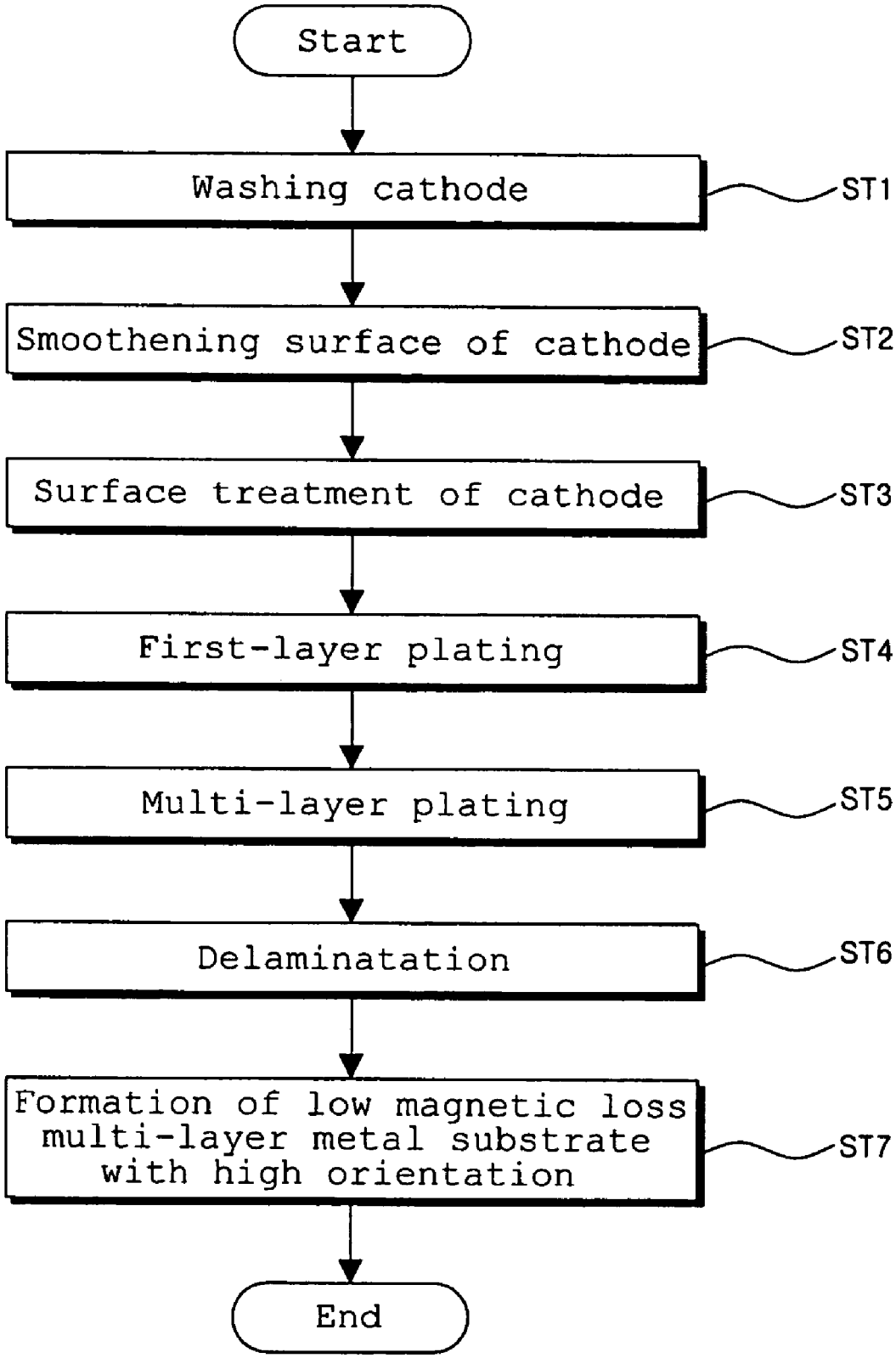
FIG. 3 is a process flow chart in accordance with the exemplary embodiment of the present invention.

FIG. 2 is a conceptual drawing of a plating bath and auxiliary devices for electroplating, and FIG. 3 is a process flow chart in accordance with an exemplary embodiment of the present invention.

As shown in the drawings, a metal plating process of growing a metal layer on a cathode having single crystalline or similarly high orientation is provided by dipping an anode 4 and a cathode 1 in a plating solution 2, and utilizing a proper current supply unit 3. For easier delamination of the metal layer formed on the cathode 1 after the plating process, the cathode 1 is washed and dipped, for several seconds to several tens of minutes, in a solution including one or more of 0-10 mol hydrochloric acid, 0-10 mol nitric acid, 0-10 mol sulfuric acid, 0-10 mol acetic acid, 0-10 mol chromic acid, 0-10 mol potassium dichromate, 0-10 mol fluoric acid, 0-10 mol lithium hydroxide, 0-10 mol sodium hydroxide, 0-10 mol potassium hydroxide, 0-10 mci ammonia water, 0-10 mol hydrogen peroxide, followed by washing and drying (ST1, ST3), prior to the plating process. A process of smoothening the surface of cathode by electro polishing may be inserted just before the pretreatment of cathode in the above solution (ST2).

In the present invention, a low magnetic loss metal layer is manufactured by utilizing a multi-layer plating process of forming nickel and non-magnetic layers. For the simplification of the process, two-layer plating having nickel/non-magnetic metal is preferable. However a multi-layer plating having more than two layers may also be possible according to the demands (ST4, ST5). Especially, in order to reduce a magnetic loss of metal tape, the thickness of nickel layer compared to that of non-magnetic metal layer has to be reduced. A plating solution including some or all of 0-600 g/l nickel sulfate, 0-600 g/l nickel sulfamate, 10-70 g/l nickel chloride, 20-80 g/l boric acid, 0-10 g/l sodium tungstate ($NaWO_3$), or 0-10 g/l cobalt chloride is used for plating nickel and nickel alloy. The pH range 1.5-6 of the plating solution is preferable, and the pH range 2-5 gives the most excellent orientation. Metals such as copper (Cu), zinc (Zn), tin (Sn), silver (Ag), gold (Au), manganese (Mn), chromium (Cr), vanadium (V), aluminum (Al), tantalum (Ta), tungsten (W), and a metal alloy composed thereof are applicable to the non-magnetic metal layer. The process condition may slightly differ according to the plating methods. Methods including direct current (DC) process, pulse current process, and periodic reverse current (PR) process are applicable to the metal plating. Average current density 1-20 $A/dm^2$ is applicable to all the above three methods. In the case of pulse current plating process, cathode current time is 1-100 msec and down time is 1-100 msec. In the case of PR plating process, cathode current time is 1-100 msec and anode current time is 1-100 msec.

The process disclosed by the present invention may be applied to manufacturing a biaxially textured metal layer in a long metal tape form.

Figure 4:
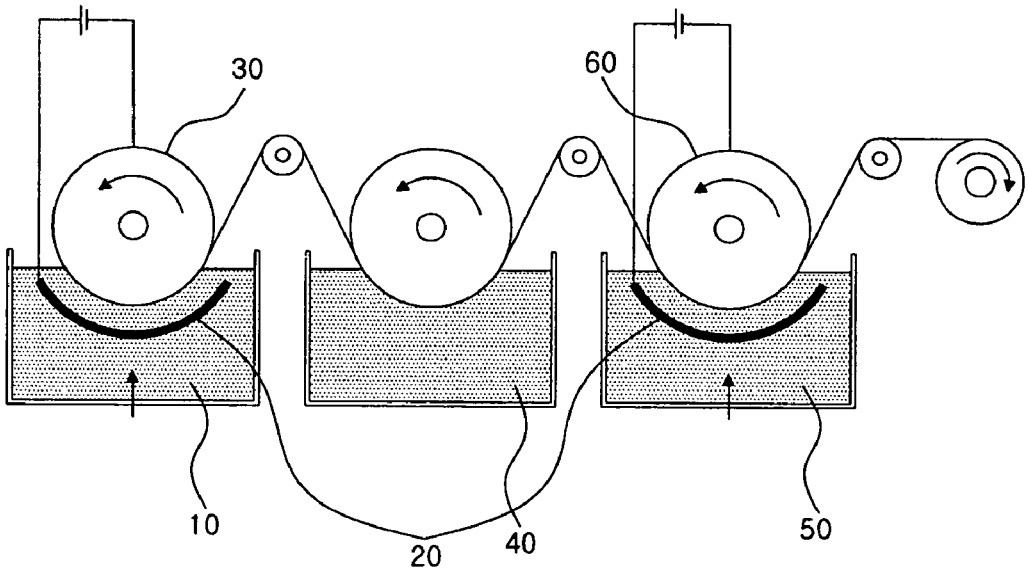
FIG. 4 is a conceptual drawing of a continuous metal plating process for manufacturing a long metal tape from a metal substrate having biaxial texture in accordance with the exemplary embodiment of the present invention.
Figure 4:
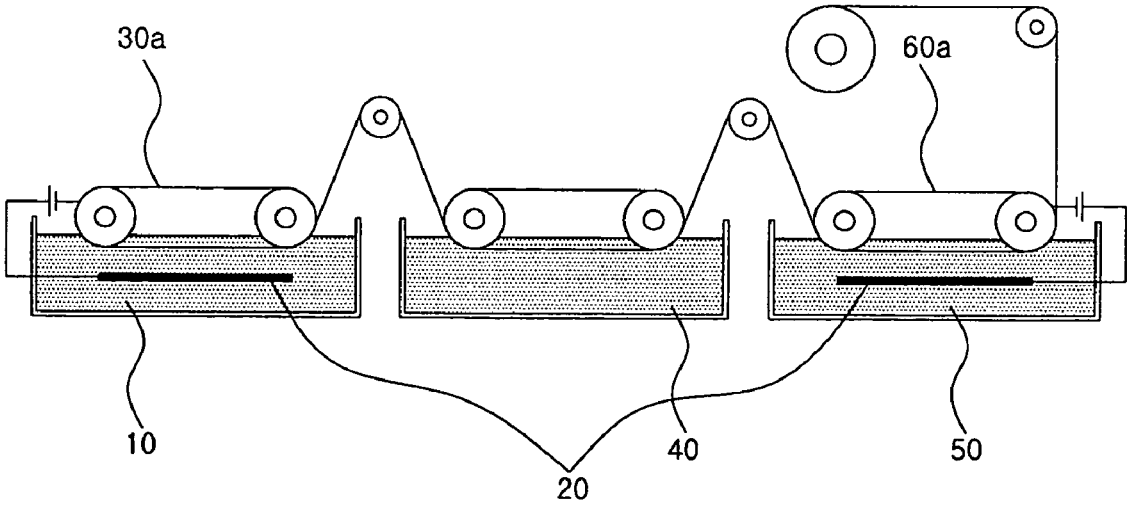

FIG. 4 is a conceptual drawing of a continuous plating process for manufacturing a long metal tape from a metal substrate having biaxial texture in accordance with the exemplary embodiment of the present invention.

As shown in FIG. 4, total plating process comprises first-layer plating, washing, and multi-layer plating. An anode 20 and a cylindrical cathode 30 having biaxially textured surface are installed in a first plating solution 10. In the plating process, a nickel layer with biaxial texture is formed on the cylindrical cathode 30 (ST4), and the nickel layer is delaminated from the cylindrical cathode 30 in the form of a tape, and the tape is then washed in a water bath 40. Subsequently, around a cylindrical cathode 60, the tape is further plated in a multi-layer plating solution 50 in the same method as the first layer plating (ST5). Finally the delaminated multi-layer metal is wound in a metal tape form (ST6,St7). In the process of the first layer plating, a biaxially oriented cathode should be used, however the surface orientation of the cathode is not important in plating a second-layer or further layer. Additionally, as shown in FIG. 4(B), a biaxially oriented metal belt 30*a* may be used as a cathode, instead of a cylindrical cathode. An anode 20 in a curve or plate shape is used to form an uniform electric field between the two electrodes.

In the meantime, the thickness and crystallinity of plating layer may be controlled by adjusting the rotational speed of cathode and the current intensity. This continuous plating process may be modified to various alternatives.

A preferred embodiment of the present invention will be described in more detail as follows.

EXAMPLE

A multi-layer plating for a Ni/Cu structure has been performed in the following condition.

Figure 5:
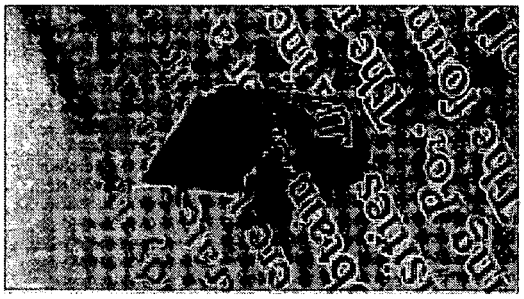
FIG. 5 is a photo of the metal tape delaminated from a cathode.

Anode: high purity nickel plate, and
high purity copper plate
Cathode: biaxially textured nickel plate
({100}<100> orientation)
Formulation of nickel plating solution:
250 g/l nickel sulfamate,
15 g/l nickel chloride, and
15 g/l boric acid
Formulation of copper plating solution:
100 g/l sulfuric acid, and
300 g/l copper sulfate
Temperature of plating: 50° C.
Time of plating: nickel: 5-20 min
copper: 20 min
Plating method: PR
Average current density: 5 A/dm$^2$ FIG. 5 shows a plating layer delaminated from the cathode formed in the above condition. It is well shown that the plating layer is formed in two layers of nickel and copper.

Figure 6:
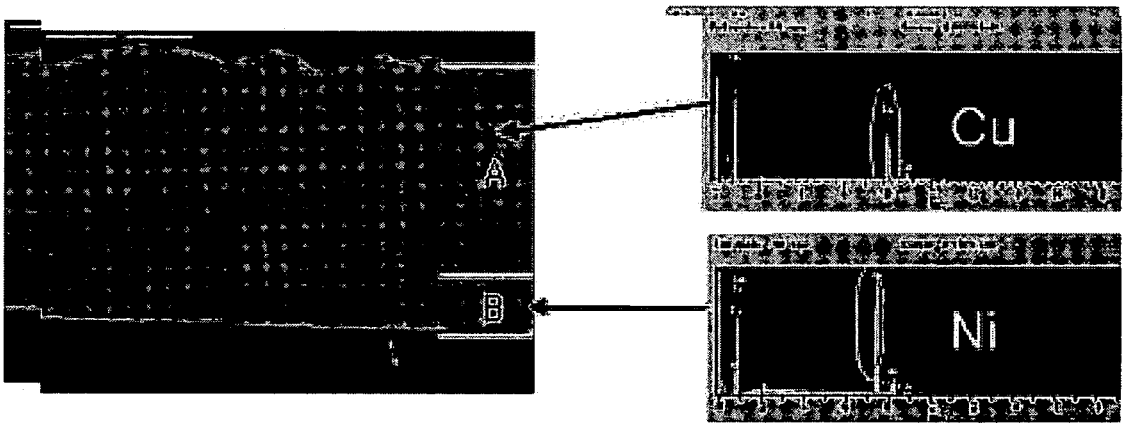
FIG. 6 is a photo showing cross-section of the metal plating layer taken by a scanning microscope in accordance with the exemplary embodiment of the present invention.

FIG. 6 is a photo showing cross-section of the plating layer taken by a scanning electron microscope. As shown in the photo, a nickel layer B and a copper layer A are apparently distinguished, and the constitution of each layer can be identified with the attached EDS result. According to the analysis result, the thickness of nickel layer is 8 μm, and the thickness of copper layer is 28 μm, which give the total thickness of 38 μm.

Figure 7:
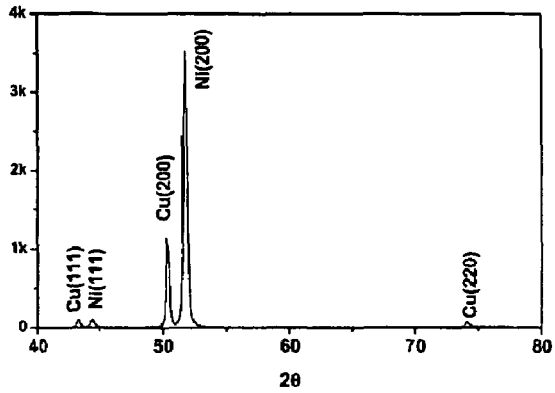
FIG. 7 is a graph showing experiment result of X-ray diffraction pattern measured for the metal tape in accordance with the exemplary embodiment of the present invention.
Figure 7:
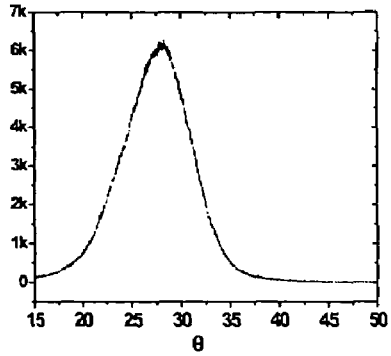
Figure 7:
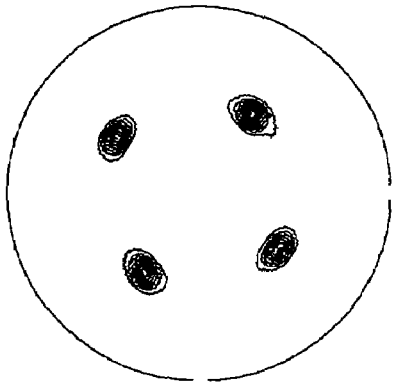
Figure 7:
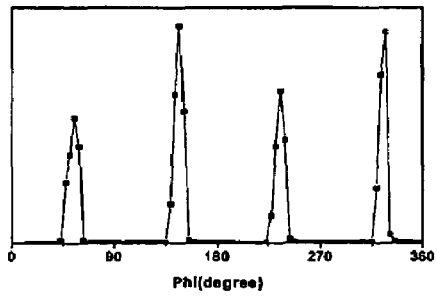

FIG. 7(A) is a graph of X-ray diffraction pattern measured for the analysis of biaxial orientation of plating layer. Referring to the graph, it may be seen that (001) peak of nickel and copper are apparently developed, and the nickel-plated surface perpendicular to the plated surface shows a very excellent texture fracture (TF) of about 0.97. FIG. 7(B) shows a θ-rocking curve measured to identify c-axis orientation of the (001) plane, where a Full Width at Half Maximum (FWHM) of the peak shows 6.2°. Additionally, a nickel (111) pole figure is measured to identify a biaxial texture. FIG. 7(C) shows the result of pole figure measured at (111) pole of the plating layer. Strong contour lines are shown at the position of Ψ-angle 54.7° and are repeated at intervals of Φ-angle 90°. From this graph, it may be identified that the plating layer has a {100}<100>-oriented cube-texture. FIG. 7(D) shows a Φ-scan measured at Ψ-angle 54.7°, and indicates that a FWHM of Ni plating layer is 7.8°.

For the analysis of magnetic characteristic of a multi-layer plating, hysteresis loop is measured by vibrational sample magnetometer (VSM). The hysteresis loop is measured in the direction parallel to the surface of the plating layer at the temperature of 77K.

Figure 8:
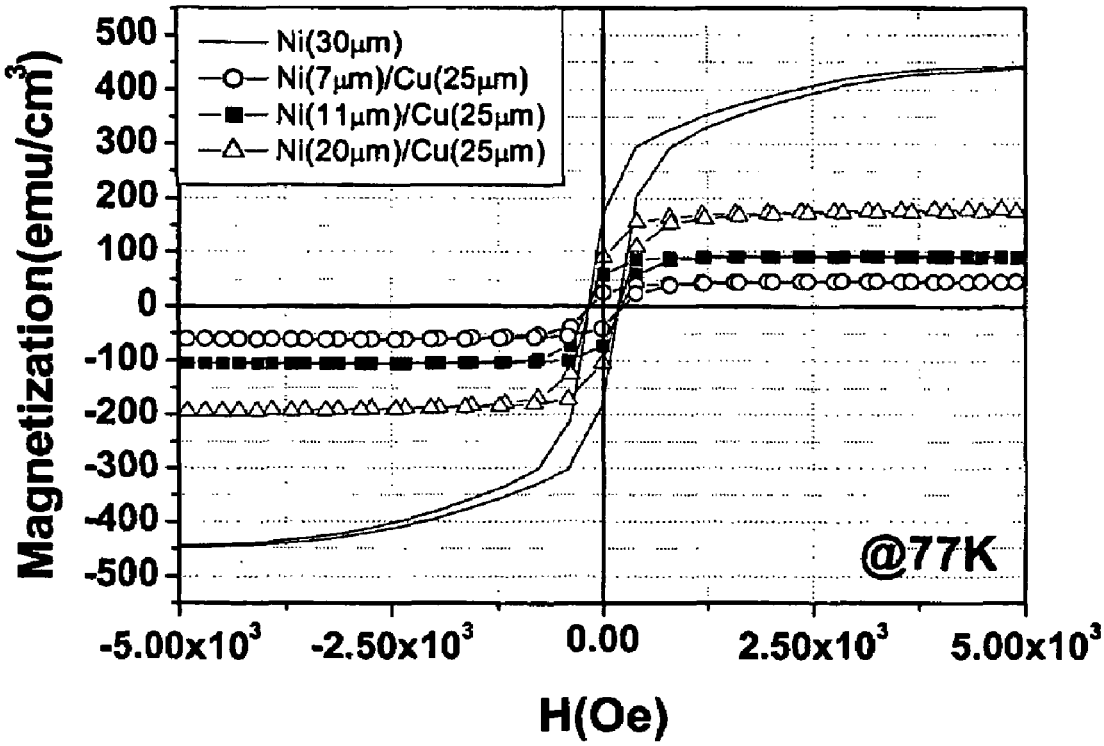
FIG. 8 is a graph showing a hysteresis loop related to the thickness of nickel and copper layers in accordance with the exemplary embodiment of the present invention.

FIG. 8 is a graph showing a hysteresis loop related to the thickness of nickel and copper layers.

As shown in FIG. 8, it is well known that saturated magnetization of multi-layer plating with nickel/copper is far lower than that of a single-layer plating with pure nickel. Especially, in the case that the thickness of nickel layer is decreasing compared to that of copper layer, the saturated magnetization of the multi-layer plating with nickel/copper shows a tendency to decrease. The saturated magnetization and magnetic loss are shown in the following Table 1.

TABLE 1

| | | Saturated Magnetization (emu/cm$^3$) | Magnetic Loss (energy loss/cycle, ergs/cm$^3$) | Remarks |
|---|---|---|---|---|
| Ni (30 μm) | | 443.2 | 165.8 | single-layer (Ni) |
| Ni (7 μm) | Cu (25 μm) | 43.8 | 20.4 | multi-layer (Ni/Cu) |
| Ni (11 μm) | | 89.1 | 42.1 | multi-layer (Ni/Cu) |
| Ni (20 μm) | | 176 | 75.0 | multi-layer (Ni/Cu) |

As shown in Table 1, if the thickness of nickel layer is decreasing compared to that of copper layer, the saturated magnetization and magnetic loss are also decreasing. Especially in the case that the time of nickel plating is short, the nickel/copper multi-layer shows far lower saturated magnetization and magnetic loss than the pure nickel.

As described above, the low magnetic loss metal tape with biaxial texture in accordance with the present invention is produced by an electroplating method performed near room temperature. The multi-layer metal tape with biaxial texture may be provided as a substrate for manufacturing a coated conductor or a thin film magnetic material, and may be applied to various magnetic devices, because magnetic characteristics are controllable by adjusting the thickness of plating layer. There are also advantages that the installation and processing costs are saved and the production speed is high, because repeated cold rolling and high temperature heat treatments are not required.

Although exemplary, non-limiting embodiments of the present invention have been described in detail hereinabove, it should be understood that many variations and/or modifications of the basic inventive concepts herein thought, which may appear to those skilled in the art, will still fall with the spirit and scope of the exemplary embodiments of the present invention as defined in the appended claims.

What is claimed is:

1. A manufacturing method of low magnetic loss metal tape with biaxial texture comprising the steps of:

(A) processing a cathode with electrolytic polishing to smooth the surface of the cathode;

(B) dipping the cathode, for at least two seconds, in a solution containing one of 10 mol or less hydrochloric acid, 10 mol or less nitric acid, 10 mol or less sulfuric acid, 10 mol or less acetic acid, 10 mol or less chromic acid, 10 mol or less potassium dichromate, 10 mol or less fluoric acid, 10 mol or less lithium hydroxide, 10 mol or less sodium hydroxide, 10 mol or less potassium hydroxide, 10 mol or less ammonia water, 10 mol or less hydrogen peroxide, or a combination of two or more components;

(C) washing and drying the cathode;

(D) forming a nickel layer with biaxial texture on a surface of the cathode rotating in an electroplating bath, the cathode having a single crystalline or similarly high orientation, and the electroplating bath including an anode made of high purity nickel;

(E) delaminating the nickel layer formed on the surface of the cathode to form a nickel layer tape and washing the nickel layer tape in a water bath;

(F) forming a non-magnetic metal layer on the washed nickel layer tape on a second cathode in a plating bath with a non-magnetic metal solution to form a nickel/non-magnetic metal layered tape; and (G) delaminating the nickel/non-magnetic metal layered tape from the second cathode and winding the nickel/non-magnetic metal layered tape.

2. The manufacturing method of low magnetic loss metal tape with biaxial texture of claim 1, wherein the cathode has a cylinder or belt shape and the anode has a curve or plan shape.

3. The manufacturing method of low magnetic loss metal tape with biaxial texture of claim 1, wherein the non-magnetic metal comprises copper (Cu), zinc (Zn), tin (Sn), silver (Ag), gold (Au), manganese (Mn), chromium (Cr), vanadium (V) aluminum (Al), tantalum (Ta), tungsten (W), and a metal alloy composed thereof.

4. The manufacturing method of low magnetic loss metal tape with biaxial texture of claim 1 wherein a plating solution used for the nickel plating in the step (D) includes some or all of 600 g/l or less nickel sulfate,0-600 g/l or less nickel sulfamate, 10-70 g/l nickel chloride, 20-80 g/l boric acid, 10 g/l or less sodium tungstate ($NaWO_3$), or 10 g/l or less cobalt chloride, and the pH range of the plating solution is from 1.5 to 6.

* * * * *